US012433335B2

(12) United States Patent
Matsuda et al.

(10) Patent No.: US 12,433,335 B2
(45) Date of Patent: Oct. 7, 2025

(54) AIRFLOW CHIMNEY

(71) Applicant: JT International SA, Geneva (CH)

(72) Inventors: Kentaro Matsuda, Tokyo (JP); Peter Loveday, Epsom (GB); Manabu Yamada, Tokyo (JP); Shen Pifa, Shenzhen (CN); Rui Cao, Shenzhen (CN)

(73) Assignee: JT International SA (CH)

( * ) Notice: Subject to any disclaimer, the term of this patent is extended or adjusted under 35 U.S.C. 154(b) by 376 days.

(21) Appl. No.: 17/802,746

(22) PCT Filed: Feb. 25, 2021

(86) PCT No.: PCT/EP2021/054767
§ 371 (c)(1),
(2) Date: Aug. 26, 2022

(87) PCT Pub. No.: WO2021/170766
PCT Pub. Date: Sep. 2, 2021

(65) Prior Publication Data

US 2023/0114975 A1 Apr. 13, 2023

(30) Foreign Application Priority Data

Feb. 28, 2020 (WO) ..... PCT/CN2020/077283

(51) Int. Cl.
*A24F 40/10* (2020.01)
*A24F 40/42* (2020.01)
(Continued)

(52) U.S. Cl.
CPC ..... *A24F 40/42* (2020.01); *A24F 40/10* (2020.01); *A24F 40/46* (2020.01); *A24F 40/485* (2020.01); *A24F 40/44* (2020.01)

(58) Field of Classification Search
None
See application file for complete search history.

(56) References Cited

U.S. PATENT DOCUMENTS

2011/0304282 A1* 12/2011 Li ..... A24F 40/50 315/362
2016/0073692 A1 3/2016 Alarcon et al.
(Continued)

FOREIGN PATENT DOCUMENTS

CN 209090053 U 7/2019
CN 209768989 U 12/2019
(Continued)

OTHER PUBLICATIONS

International Search Report for Application No. PCT/EP2021/054767 mailed May 10, 2021, pp. 1-4.
(Continued)

*Primary Examiner* — Katherine A Will
(74) *Attorney, Agent, or Firm* — Lerner David LLP

(57) ABSTRACT

A capsule for an electronic cigarette has a first end configured to engage with an electronic cigarette device, a second end having a vapor outlet, a liquid store configured to contain a liquid to be vaporized; a vaporizer housing arranged to house at least a part of a heating element and a part of a fluid transfer element arranged to deliver liquid from the liquid store to the heating element, the heating element being configured to vaporize the received liquid and generate a vapor; a seal arranged to hold the vaporizer housing; a holder arranged to attach to the seal; a main gas flow channel extending between the vaporizer housing and the vapor outlet; a pair of electrodes arranged to provide an electrical connection between the first end of the capsule and an electronic cigarette device; where the holder comprises an airflow passageway.

20 Claims, 11 Drawing Sheets

(51) Int. Cl.

| | |
|---|---|
| ***A24F 40/46*** | (2020.01) |
| ***A24F 40/485*** | (2020.01) |
| *A24F 40/44* | (2020.01) |

(56) References Cited

U.S. PATENT DOCUMENTS

| | | | |
|---|---|---|---|
| 2017/0006917 | A1 | 1/2017 | Alvarez |
| 2018/0077967 | A1 | 3/2018 | Hatton et al. |
| 2021/0059308 | A1 | 3/2021 | Lin et al. |
| 2022/0218037 | A1 | 7/2022 | Lei |

FOREIGN PATENT DOCUMENTS

| | | | |
|---|---|---|---|
| CN | 110638101 | A | 1/2020 |
| WO | 2019137561 | A1 | 7/2019 |
| WO | 2020030792 | A1 | 2/2020 |

OTHER PUBLICATIONS

International Search Report for Application No. PCT/EP2021/054768 mailed Jul. 22, 2021, pp. 1-4.
Communication pursuant to Article 94(3) EPC for European Application No. 21708962.2, dated Jun. 23, 2025, pp. 1-6.

* cited by examiner

AIRFLOW CHIMNEY

CROSS-REFERENCE TO RELATED APPLICATIONS

The present application is a national phase entry under 35 U.S.C. § 371 of International Application No. PCT/EP2021/054767, filed Feb. 25, 2021, published in English, which claims priority to International Application No. PCT/CN2020/077283 filed Feb. 28, 2020, the disclosures of which are incorporated herein by reference.

FIELD OF INVENTION

The present invention relates to personal vaporizing devices, such as electronic cigarettes. In particular, the invention relates to capsules having an airflow chimney, the capsules to be used with an electronic cigarette.

BACKGROUND

Electronic cigarettes are an alternative to conventional cigarettes. Instead of generating a combustion smoke, they vaporize a liquid, which can be inhaled by a user. The liquid typically comprises an aerosol-forming substance, such as glycerin or propylene glycol that creates the vapor. Other common substances in the liquid are nicotine and various flavorings.

The electronic cigarette is a hand-held inhaler system, comprising a mouthpiece section, a liquid store, a power supply unit. Vaporization is achieved by a vaporizer or heater unit which typically comprises a heating element in the form of a heating coil and a fluid transfer element. The vaporization occurs when as the heater heats up the liquid in the wick until the liquid is transformed into vapor. The electronic cigarette may comprise a chamber in the mouthpiece section, which is configured to receive disposable consumables in the form of capsules. Capsules comprising the liquid store and the vaporizer are often referred to as "cartomizers".

Conventional cigarette smoke comprises nicotine as well as a multitude of other chemical compounds generated as the products of partial combustion and/or pyrolysis of the plant material. Electronic cigarettes on the other hand deliver primarily an aerosolized version of an initial starting e-liquid composition comprising nicotine and various food safe substances such as propylene glycol and glycerine, etc., but are also efficient in delivering a desired Nicotine dose to the user. The aerosol generated by an electronic cigarette is generally referred to as a vapor.

In order to ensure that sufficient vapor is generated, to provide the user with a satisfying user experience, it is important to ensure that the liquid is prevented from leaking from the liquid store and into the capsule or electronic cigarette.

Furthermore, liquid leaking from the liquid store may travel to the power supply, or other electronics, and could cause the electrical circuitry to short out. This is dangerous and could potentially lead to injury of a user.

It is an object of the present invention to reduce the likelihood of liquid leaking from the liquid store. It is also an object of the invention to provide a device having fewer components so that it is cheaper and simpler to manufacture.

SUMMARY OF INVENTION

According to a first aspect there is provided a capsule for an electronic cigarette, the capsule having a first end configured to engage with an electronic cigarette device and a second end having a vapor outlet, the capsule further comprising:

- a liquid store configured to contain a liquid to be vaporized;
- a vaporizer housing arranged to house at least a part of a heating element and a part of a fluid transfer element, wherein the fluid transfer element is arranged to deliver liquid from the liquid store to the heating element, the heating element being configured to vaporize the received liquid and generate a vapor;
- a seal arranged to hold the vaporizer housing;
- a holder arranged to attach to the seal;
- a main gas flow channel extending between the vaporizer housing and the vapor outlet to allow the generated vapor to flow from the vaporizer housing to the vapor outlet;
- a pair of electrodes, wherein the electrodes are arranged to provide an electrical connection between the first end of the capsule and an electronic cigarette device;

wherein the holder comprises an airflow passageway.

The airflow passageway forms part of the main gas channel. The air flow passageway may extend from a surface of the holder into the vaporizer housing. In this case, the air flow passageway may be integrally formed with the surface of the holder. This reduces the overall number of components present in the capsule, making the capsule cheaper and simpler to manufacture. Furthermore, by having the airflow passageway integrally formed with the holder, such that the airflow passageway is a part of the holder, there is no join between the airflow passageway and the holder, which reduces the chance leakage from the capsule. That is to say, by reducing the number of joins between components, the capsule is better sealed against fluid leaks.

The airflow passageway may be formed as a chimney or tubular extension protruding in the vaporizing housing. This arrangement means that the chimney provides a direct airflow pathway into a cavity of the holder, which reduces the risk of leakage.

Preferably, the main gas flow channel extends from the holder, through the seal, to the vaporizer housing. The main gas flow channel therefore extends along the whole length of the capsule. This ensures that air is drawn through the length of the capsule to the mouthpiece, allowing the generated vapor to flow from the vaporizer housing to the vapor outlet.

Preferably, the airflow passageway comprises a vaporizing chamber surrounding the airflow passageway. The airflow passageway is preferably formed as a chimney or tubular extension protruding in the vaporizing housing. Furthermore, the holder forms a cavity about the airflow passageway which is closed from the outside. As a result, vapor and liquid is better contained in the vaporizing chamber, e.g. as it can be collected in the cavity, and so the risk of leakage from the air entry is reduced. Preferably, the airflow passageway forms an integral part of the holder.

Preferably, the airflow passageway extends into the vaporizer housing away from the holder, for example in a vertical direction, when the capsule is held in a vertical position. In other words, the airflow passageway may extend parallel to a longitudinal axis of the capsule. This ensures that air is directed efficiently into the part of the capsule where it is needed i.e. the vaporizer housing. A vertical extension provides the shortest, and therefore most efficient, route between the holder and the vaporizer housing.

In some cases, the airflow passageway is located substantially centrally within the surface of the holder. Airflow out of the airflow passageway and into the vaporizer housing is therefore delivered centrally to the vaporizer housing, rather to one side of the vaporizer housing. Better airflow within the vaporizer housing can therefore be achieved. This results in a more efficient generation of vapor within the vaporizing housing.

The airflow passageway may comprise a plurality of grooves on an external surface of the airflow passageway. The grooves may take the form of shallow recesses within the surface of the airflow passageway. The grooves may be arranged to receive fluid and allow this fluid to flow along the surface of the airflow passageway. The grooves may collect fluid that may have leaked from the fluid transfer element and direct this fluid away from the airflow passageway via the grooves. The leaked liquid is therefore contained within defined areas, i.e. the grooves, rather than being allowed to leak and flow over the entire surface of the airflow passageway. This reduces the likelihood of leaked fluid damaging components within the capsule as the leaked fluid is contained, or confined, within the grooves.

The grooves may be substantially straight, which may provide an efficient pathway along which fluid captured in the grooves may flow. The grooves may also be substantially equally spaced apart from each other. This ensures that any fluid that has leaked from the fluid transfer element onto the external surface of the airflow passageway can be captured, via capillary action, relatively quickly by at least one groove, which reduces the chance of the leaked fluid traveling over the surface of the airflow passageway.

Preferably, the grooves extend longitudinally along the external surface of the airflow passageway. More preferably, the grooves extend along the entire length of the external surface of the airflow passageway. This configuration helps allow the quick and efficient transfer of any fluid that has been captured by the grooves along the surface of the airflow passageway.

In some developments, the holder may comprise a plurality of channels located within an internal surface of the holder. The internal surface may be part of a base surface of the holder. The internal surface may therefore comprise a system of channels at least some of which may be in fluid communication with each other. These channels may advantageously collect fluid that has leaked from the fluid transfer element onto the internal surface of the holder. Through capillary action, the channels may capture and direct the leaked fluid away from important components within the capsule, for example they may direct the captured fluid away from electronics within the capsule. This reduces the chance of leaked fluid within the capsule causing short circuits.

Preferably, at least one of the grooves is in fluid communication with at least one of the channels. Any leaked fluid that has been captured by the grooves may therefore be allowed to flow into the channels within the holder. These channels may be used to drain any fluid that has leaked from the fluid transfer element. By ensuring that at least some of the grooves are in fluid communication with at least some of the channels means that leaked fluid can be drained from the capsule at a single drainage point, rather than providing separate drainage points for the groves and the channels. This reduces the complexity of the capsule, resulting in cheaper and quicker manufacturing processes. Furthermore, fewer separate components are needed as space is used more efficiently within the capsule.

An interface may be formed between an internal surface of the seal and an internal surface of the holder. Preferably, the heating element comprises first and second lead wires, and preferably the first and second lead wires of the heating element are located at the interface between the seal and the holder. The interface may therefore act to hold the first and second lead wires of the heating element between the seal and the holder. The interface therefore acts to hold or squeeze in place the first and second lead wires of the heating element. This configuration reduces the need for separate joining, or attachment, components to secure the heating element within the capsule. Thus, the overall number of parts provided is reduced, resulting in a simpler capsule device.

The heating element comprises a heating coil in contact with the fluid transfer element, which may also be referred to as a wick. The heating coil is connected (for example soldered or connected by connectors) to a plurality of lead wires, typically two lead wires, which form the first and second ends of the heating coil. Thus, the first and second lead wires may also be referred to as first and second ends of the heating element. It should be noted that the heating coil is not connected directly to the electrodes. Instead the heating coil is indirectly connected to the electrodes via the lead wires which act as intermediates between the heating coil and the electrodes. The heating element is therefore indirectly connected to the electrodes.

The lead wires which are made of a material that does not transfer the heat to the electrodes.

In general, the seal may be formed of a rubber or thermoplastic elastomer material.

In some examples, the first and second ends of the heating element are compressed between the seal and the holder at the interface. Compressing the first and second ends between the seal and the holder ensures that the first and second ends of the heating element are securely held at the interface, reducing the likelihood of the first and seconds of the heating element becoming loose within the capsule.

According to further aspect there is provided an electronic cigarette comprising a main body and a capsule wherein the main body comprises a power supply unit, electrical circuitry, and a capsule seating configured to connect with the capsule, wherein the capsule is a capsule according to any of the above-described capsules.

The electronic cigarette may be configured to connect with a capsule according to any of the previously described capsules.

As the skilled person will appreciate, any feature described herein may be combined together individually or in combination. They may also be combined with any aspect described above either individually or in combination.

BRIEF DESCRIPTION OF DRAWINGS

Embodiments of the invention will now be described by way of example of with reference to the accompanying drawings in which.

DETAILED DESCRIPTION

Figure 1A:
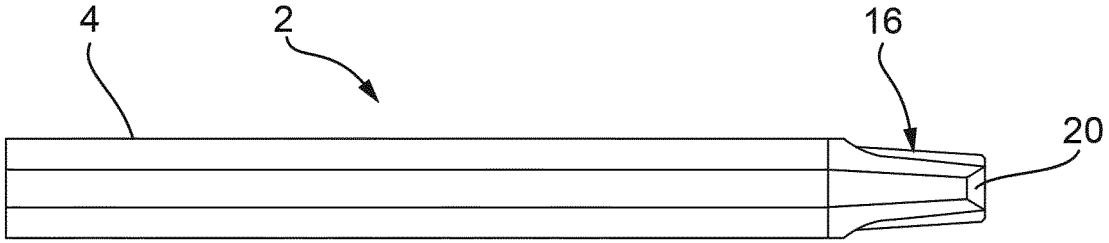
FIG. 1A is a schematic perspective view of an electronic cigarette.
Figure 1B:
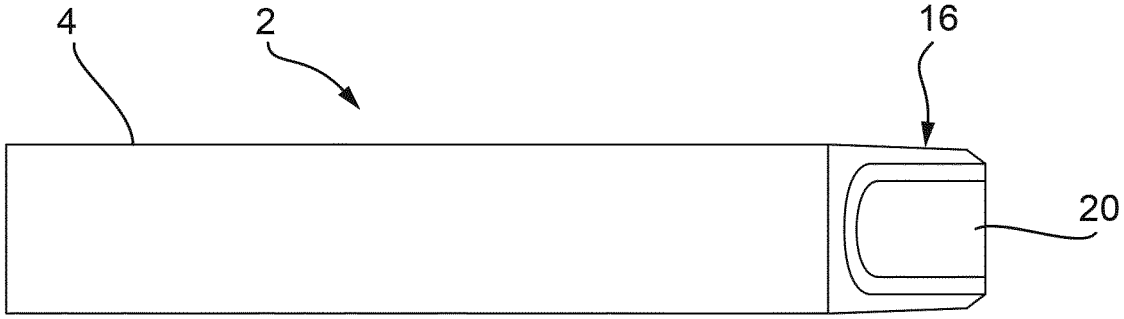
FIG. 1B is a schematic perspective side view of the electronic cigarette of FIG. 1A.
Figure 1C:
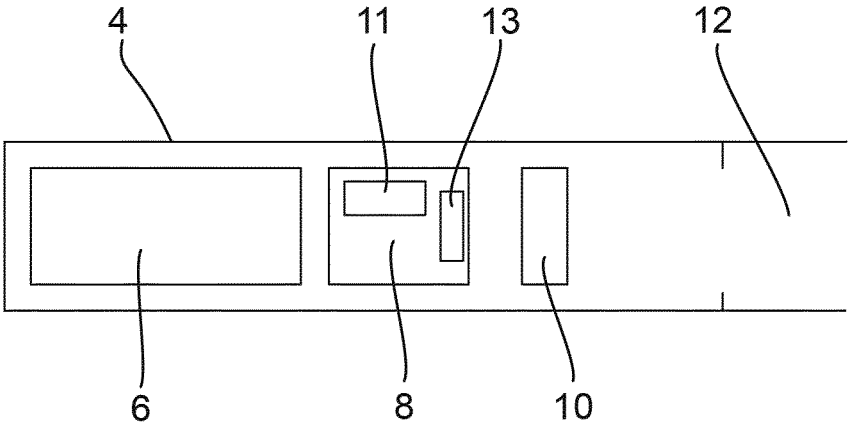
FIG. 1C is a schematic cross-sectional view of the electronic cigarette of FIGS. 1A and 1B.

As used herein, the term "inhaler" or "electronic cigarette" may include an electronic cigarette configured to deliver an aerosol to a user, including an aerosol for smoking. An aerosol for smoking may refer to an aerosol with particle sizes of 0.5-7 microns. The particle size may be less than 10 or 7 microns. The electronic cigarette may be portable.

Referring to the drawings and in particular to FIGS. 1A to 1C, 2A and 2B, an electronic cigarette 2 for vaporizing a liquid L is illustrated. The electronic cigarette 2 can be used as a substitute for a conventional cigarette. The electronic cigarette 2 has a main body 4 comprising a power supply unit 6, electrical circuitry 8 and a capsule seating 12. The capsule seating 12 is configured to receive removable capsules 16 comprising a vaporizing liquid L. The liquid L may comprise an aerosol-forming substance such as propylene glycol and/or glycerol and may contain other substances such as nicotine and acids. The liquid L may also comprise flavorings such as e.g. tobacco, menthol or fruit flavor.

The capsule seating 12 is preferably in the form of a cavity configured to receive the capsule 16. The capsule seating 12 is provided with a connection portion 21 configured to hold the capsule 16 firmly to the capsule seating 12. The connection portion 21 could for instance be an interference fit, a snap fit, a screw fit, a bayoneted fit or a magnetic fit. The capsule seating 12 further comprises a pair of electrical connectors 14 configured to engage with corresponding power terminals 45 on the capsule 16.

Figure 2A:
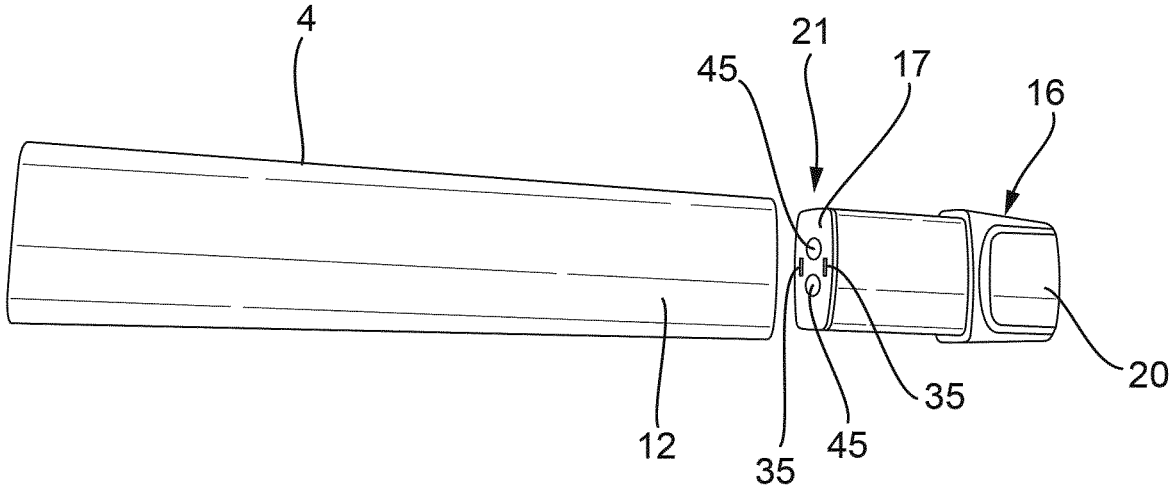
FIG. 2A is a schematic perspective view of the electronic cigarette in FIGS. 1A and 1B, wherein the capsule has been disconnected from the electronic cigarette.
Figure 2B:
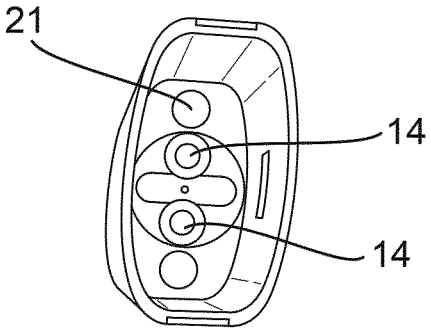
FIG. 2B is a schematic perspective view of a capsule seating.

As best seen in FIGS. 2A and 2B, the capsule 16 comprises a housing 18, a liquid store 32, a vaporizing unit 34 and power terminals 45. The housing 18 has a mouthpiece portion 20 provided with a vapor outlet 28. The mouthpiece portion 20 may have a tip-shaped form to correspond to the ergonomics of the user's mouth. On the opposite side of mouthpiece portion 20, another connection portion 22 is located. The mouthpiece connection portion 22 is configured to connect with the connection portion 21 in the capsule seating 12. The connection portion 21 on the capsule 16 may comprise a metallic plate, configured to magnetically connect to a magnetic surface in the capsule seating 12. The capsule housing 18 may be in a transparent material, whereby the liquid level of the capsule 16 is clearly visible to the user. The housing 18 may be formed in a polymeric or plastic material, such as polyester.

Figure 4:
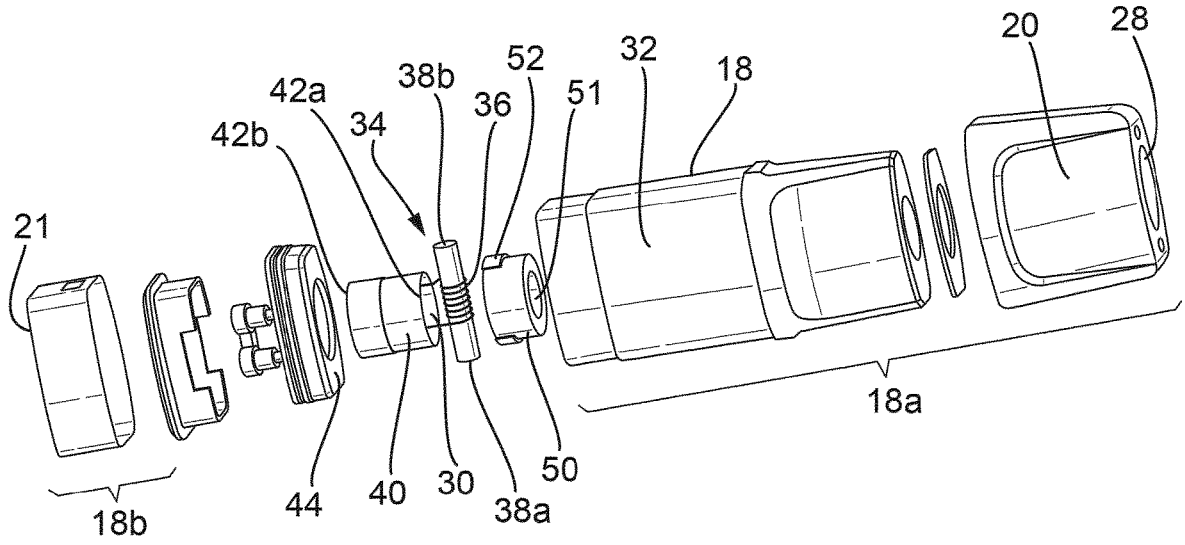
FIG. 4 is an exploded schematic view of a capsule.

As seen in FIG. 4, the capsule 16 may be assembled from a plurality of different parts. However, the illustrated embodiment is schematic and it is also possible to combine some of the parts to single units which will be apparent to a person skilled in the art. The present configuration of a plurality of different parts enables an efficient assembly of the capsule 16.

The capsule housing 18 may be formed from a top housing 18*a* and a bottom housing 18*b* or a base 18*b*. The parts can be assembled together by a friction fit between the top housing 18*a* and a bottom housing 18*b*. Additionally, or alternatively, the top housing 18*a* and a bottom housing 18*b* can be joined together by ultrasonic welding. Optionally, as illustrated in the figure, the top housing 18*a* may comprise the mouthpiece portion 20 as a separate part that is assembled to the top housing 18*a* of the capsule.

Figure 3A:
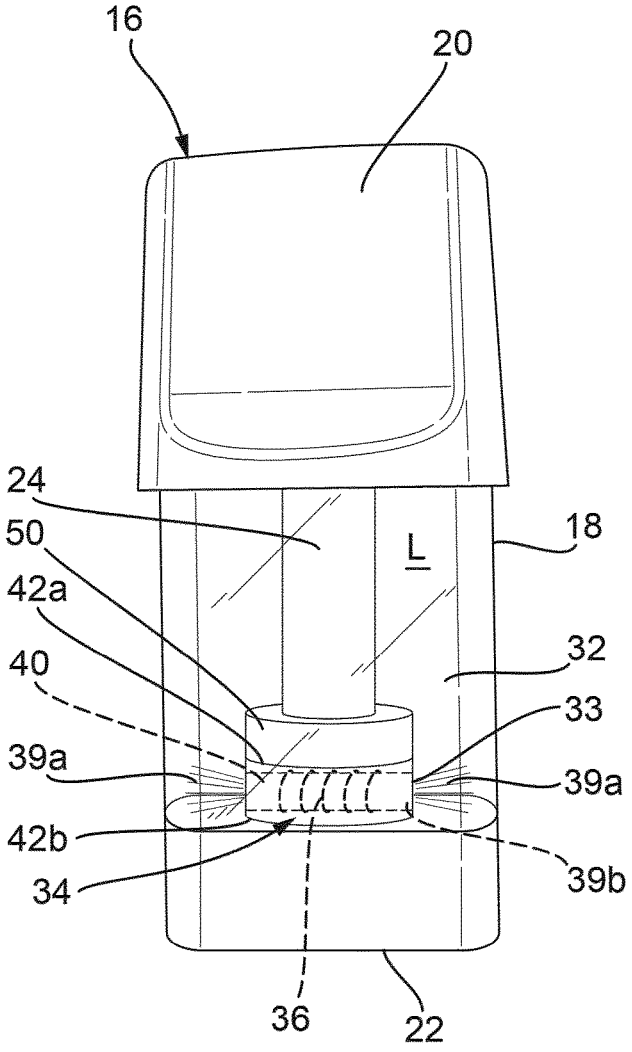
FIG. 3A is a schematic view of a capsule.
Figure 3B:
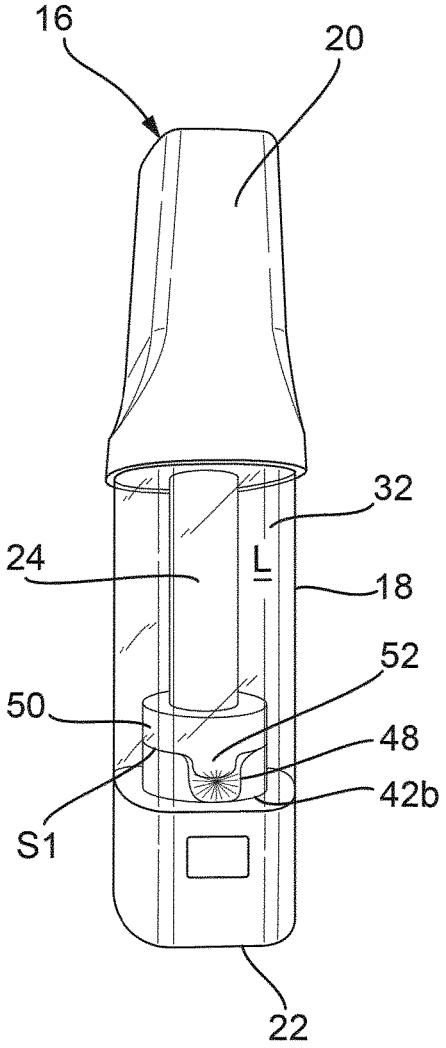
FIG. 3B is a schematic side view of the capsule of FIG. 3A.

As shown in FIG. 3A together with FIG. 4, the vaporizing chamber 30 is located at the opposite distal end of the capsule 16 to the mouthpiece portion 20 and houses the vaporizing unit 34. From the vaporizing chamber 30 to the vapor outlet 28 in the mouthpiece portion 20, a main vapor channel 24 is defined which may have a tubular cross-section. The main vapor channel 24 can be formed from a tube or chimney 24 which extends distally away from the mouthpiece where it may be sealingly connected to the vaporizing chamber 30. Conveniently the tube or chimney 24 can formed integrally with the top housing. This part can for instance be produced by injection molding or molding. Once the tube or chimney 24 is connected to the vaporizing chamber 30, the main vapor channel is formed.

The vaporizing chamber 30 is surrounded by the liquid store 32. It is sealed such that it only receives liquid through a liquid delivery channel 33, receives intake air from an air inlet 35, and delivers vapor through the main vapor channel (via tube or chimney 24). To this effect, the vaporizing unit 34 is accommodated inside a tubular vaporizer housing 40.

In order to provide an optimal user experience when using the electronic cigarette 2 for, it is important to prevent liquid leaking from the liquid store 32 and into the capsule 16. It is also important to prevent liquid leaking from the capsule 16 and into the capsule seating 12. There are a number of potential leakage points that have been identified in the electronic cigarette 2 which need to be effectively sealed against the liquid. Firstly, liquid may leak from around the fluid transfer element 38 into the main vapor channel and along the main flow path through the capsule 16.

Liquid may also leak from the liquid store 32 or from the fluid transfer element 38 into the air inlet 35 and out through the capsule 16 and potentially into the capsule seating 12 in which the electrical circuitry 8 is housed. This could potentially cause the electrical circuitry 8 to short out.

There is also a risk that liquid leaks from any gaps that may be present in the vaporizing unit 34, between the heating element 36, the fluid transfer element 38, and the liquid store 32.

In order to reduce the risk of leakage from the capsule 16, first 50 and second 44 seals are provided. The vaporizer housing 40 has an upper rim 42*a* and a lower rim 42*b*, the upper rim 42*a* being in contact with the first seal 50, which may also be referred to as an upper gasket 50, and the lower rim 42*b* being in contact with the second seal 44, which may also be referred to as a lower gasket 44. The first and second seals 44, 50 are typically made of a resilient or compressible material, for example silicon, to minimize leakage through the connections. The lower gasket 44 is configured to seal around the outer circumference of the tubular vaporizer housing 40.

The vaporizing unit 34 comprises a heating element 36 and a fluid transfer element 38. The fluid transfer element 38 is configured to transfer the liquid L by capillary action from the liquid store 32 to the heating element 36. The fluid transfer element 38 can be a fibrous or porous element such as a wick made from twined cotton or silica. Alternatively, the fluid transfer element 38 can be any other suitable porous element.

The vaporizing chamber 30 is fluidly connected to the liquid store 32 by the fluid transfer element 38. Hence, the liquid inlet to the vaporization chamber 30 is provided solely through the fluid transfer element 38 and through the passages 33 formed from the porous structures of the fluid transfer element 38.

The fluid transfer element 38 has a first end 38*a* and a second end 38*b*. The fluid transfer element 38 is provided with an elongated and substantially straight shape. Typically, the fluid transfer element 38 is arranged with its longitudinal extension perpendicular or traverse to the longitudinal direction of the cartridge 16. The fluid transfer element 38 has a liquid uptake portion 39*a* located inside the liquid store 32 and a liquid delivery portion 39*b* in contact with the heating element 36 inside the vaporization chamber 30.

The liquid uptake portion 39*a* corresponds to the first end 38*a* and a second end 38*b* of the fluid transfer element 38. The heating element 36 is positioned on the liquid delivery portion 39*b* of the fluid transfer element 38. The liquid delivery portion 39*b* corresponds to the center portion of the elongate fluid transfer element 38. As shown in the figures, the heating element 36 is provided on the outside circumference of the fluid transfer element 38.

The vaporizer housing 40 is further provided with a pair of cutouts 48 through which the first and the second ends 38*a*, 38*b* of the fluid transfer element 38 are received. The first seal 50 is located in the connection between the vaporization chamber 30 and the fluid transfer element 38. The first seal 50 has a contact surface S1 that corresponds to the shape of the upper rim 42*a* of the vaporizer housing 40. The first seal 50 is further provided with an aperture 51 through which the vapor can flow from the vaporization chamber 30 to the main vapor flow channel.

Figure 5:
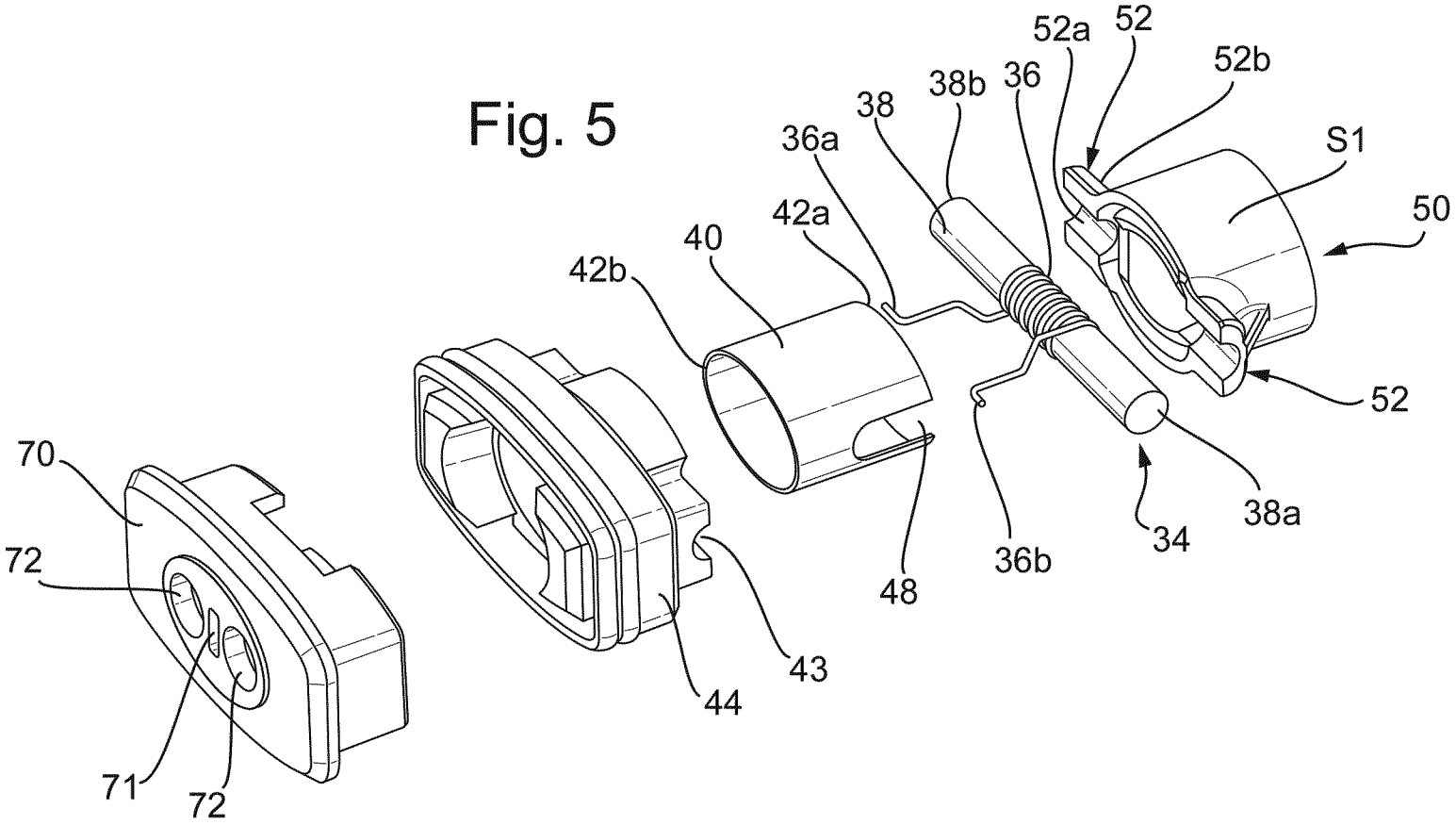
FIG. 5 is an exploded schematic view of capsule seals.

As shown in FIG. 5, the first seal 50 comprises a pair of radially extending shoulder portions 52, which extend in a direction substantially perpendicular to a longitudinal axis of the electronic cigarette 2. The shoulder portions 52 are generally curved in shape, for example taking the form of an arc or semi-circle, and having an inwardly curving surface 52*a*, which may be thought of as a concave surface 52*a*, and an outwardly curving surface 52*b*, which may be thought of as a convex surface 52*b*. When the electronic cigarette 2 is held in a vertical position, the concave surface 52*a* is located below the convex surface 52*b* such that the shoulder portions may be described as substantially "n"-shaped.

The inwardly curved surface 52*a* of the shoulder portions 52 is shaped to correspond to the shape of the first and second ends 38*a*, 38*b* of the fluid transfer element 38. In other words, the curvature of the first and second ends of the fluid transfer element 38 substantially corresponds to the curvature of the inwardly curving surface 52*a* of the shoulder portions 52. Having curved surfaces that substantially corresponds to each other ensures a close fit between the two neighboring surfaces, which in this case are the surface of the fluid transfer element 38 and the concave surface of the shoulder portion 52, when the electronic cigarette 2 is constructed. This is important for preventing leakage, as any gaps or "wiggle room" created through loose fitting parts creates a potential pathway for liquid to travel along and leak from the capsule 16.

The shoulder portions 52 are configured to be received in the cutouts 48 of the vaporizer housing 40 and to press against, i.e. apply pressure to, the fluid transfer element 38 when the capsule 16 is assembled. The first seal 50 is configured to compress the fluid transfer element 38 in the radial direction of the fluid transfer element 38. The tight fit achieved by having complementary adjacent surfaces of the ends of the fluid transfer element 38 and the concave surfaces 52*a* of the seal 50 improves the ability of the seal 50 to apply a suitable pressure to the fluid transfer element 38. By compressing the fluid transfer element 38, the liquid flow from the liquid store 32 to the vaporization chamber 30 is guided through the fluid transfer element 38. Hence, leakage around the fluid transfer element 38 is prevented.

Figure 7:
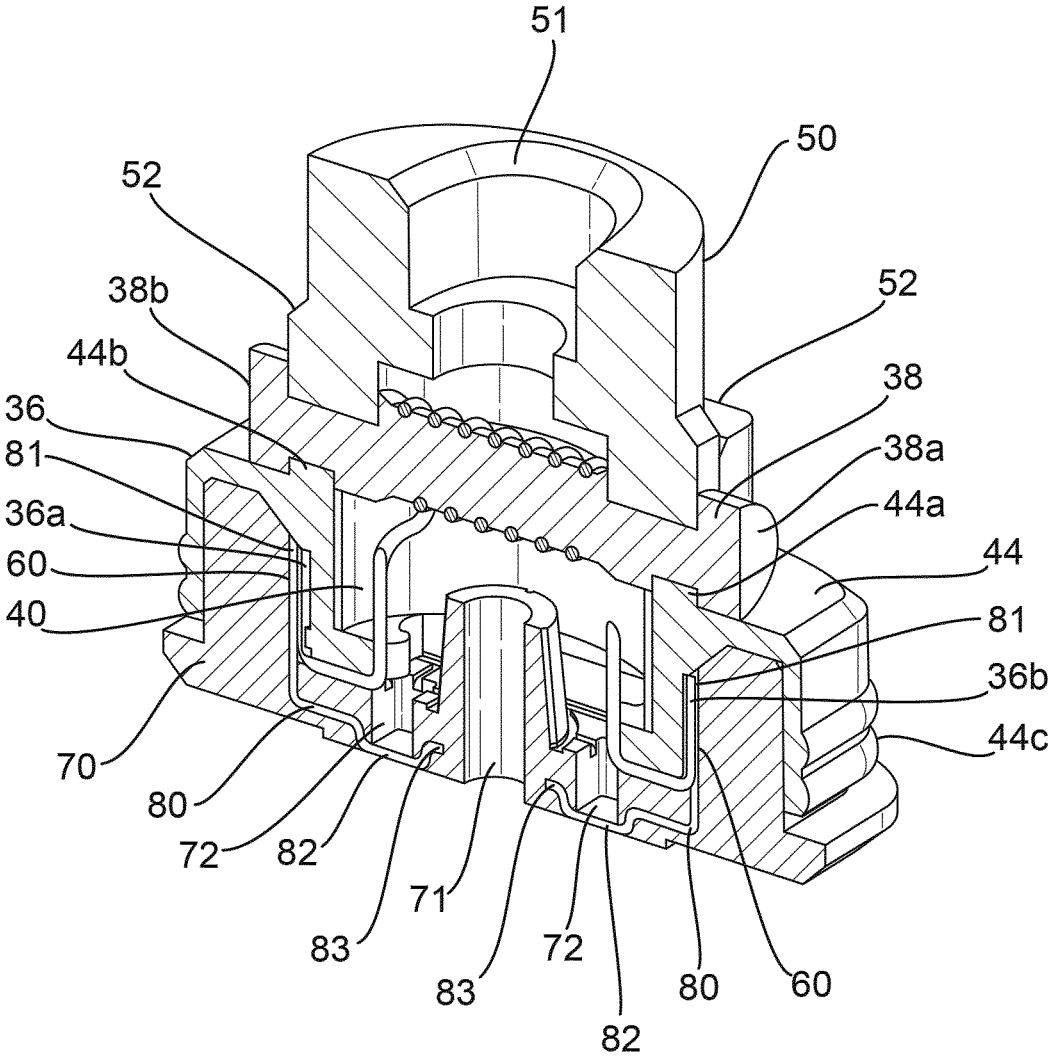
FIG. 7 is a schematic perspective view of FIG. 6.

The second seal 44 also comprises a pair of shoulder portions 44*a*, 44*b* which extend radially away from the main body of the second seal 44. That is to say, the pair of shoulder portions 44*a*, 44*b* extend in a direction substantially perpendicular to a longitudinal axis of the electronic cigarette 2, as can be seen in FIGS. 5 and 7. Similarly to the shoulder portions 52 of the first seal 50, these shoulder portions 44*a*, 44*b* on the second seal 44 are generally curved in shape, for example taking the form of an arc or semi-circle. Again, these shoulder portions 44*a*, 44*b* have an inwardly curving surface 43, which may be thought of as a concave surface 43. When the electronic cigarette 2 is held in a vertical position, the concave surface 43 may be described as substantially "u"-shaped.

The inwardly curved surface 43 is shaped to correspond to the shape of the first and second ends 38*a*, 38*b* of the fluid transfer element 38. That is to say, the curvature of the first and second ends of the fluid transfer element 38 substantially corresponds to the curvature of the inwardly curving surface 43 of the shoulder portions 44*a*, 44*b*. Providing curved surfaces that substantially correspond to each other ensures a close fit between the two neighboring surfaces, which in this case are the surface of the fluid transfer element and the concave surface of the shoulder portion 44*a*, 44*b*, when the electronic cigarette 2 is constructed. A close or tight fit is important for preventing leakage, because any gaps between components which are loosely fitting creates a potential flow path for liquid to travel along and leak from the capsule 16.

Figure 8A:
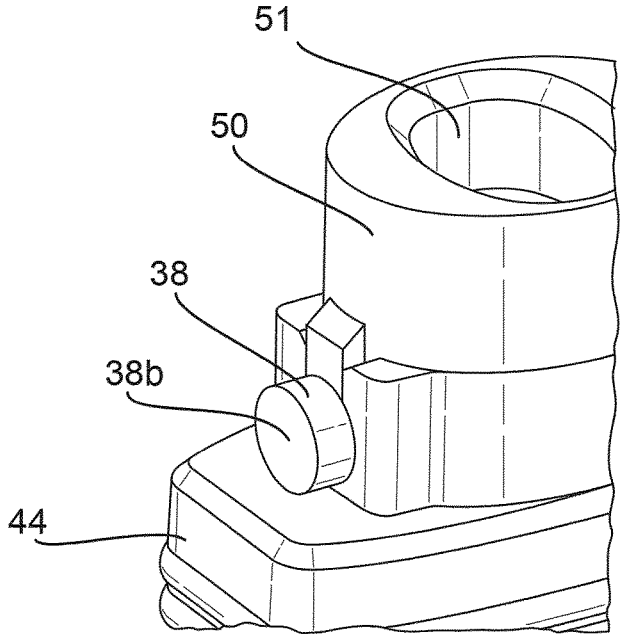
FIG. 8A is a perspective view of a capsule seal.
Figure 8B:
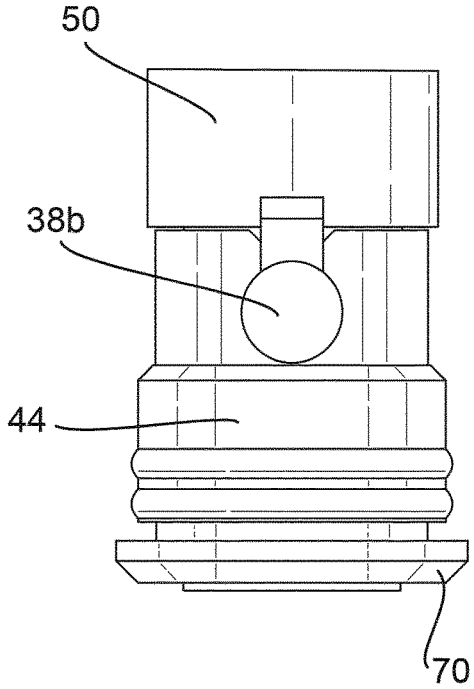
FIG. 8B is a sideways view of a capsule seal.
Figure 8C:
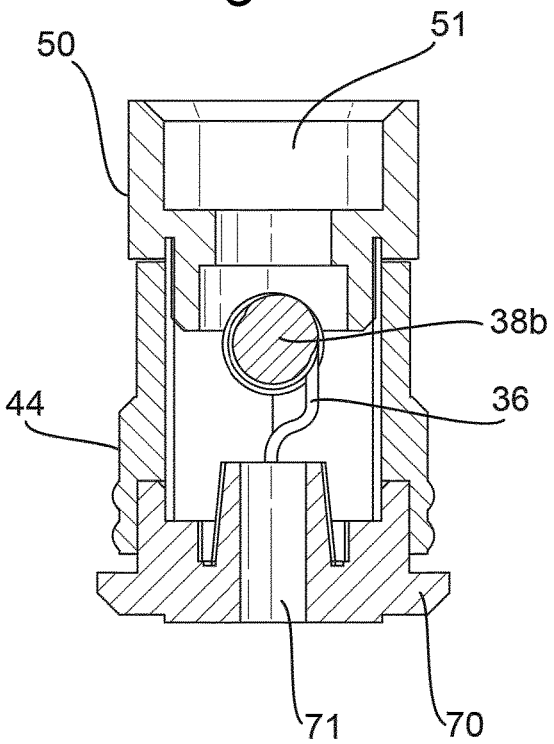
FIG. 8C is a cross-sectional view of FIG. 8B.

The shoulder portions 44*a*, 44*b* of the second seal 44 are also configured to cooperate with the shoulder portions 52 of the first seal 50. By this we mean that the first and second seals are in contact with each other. This ensures that the fluid transfer element 38 is tightly held between the first and second seals, helping prevent fluid from leaking from the fluid transfer element 38 into the electronic cigarette 2. This tight seal can be seen more clearly in FIGS. 8A-8C. Additionally, by having the first seal 50 in contact with a surface of the second seal 44, the first seal 50 is able to apply a sufficient compressive force to the fluid transfer element 38 when the fluid transfer element 38 is held between the first and second seals, helping prevent leakage from around the seals.

Figure 6:
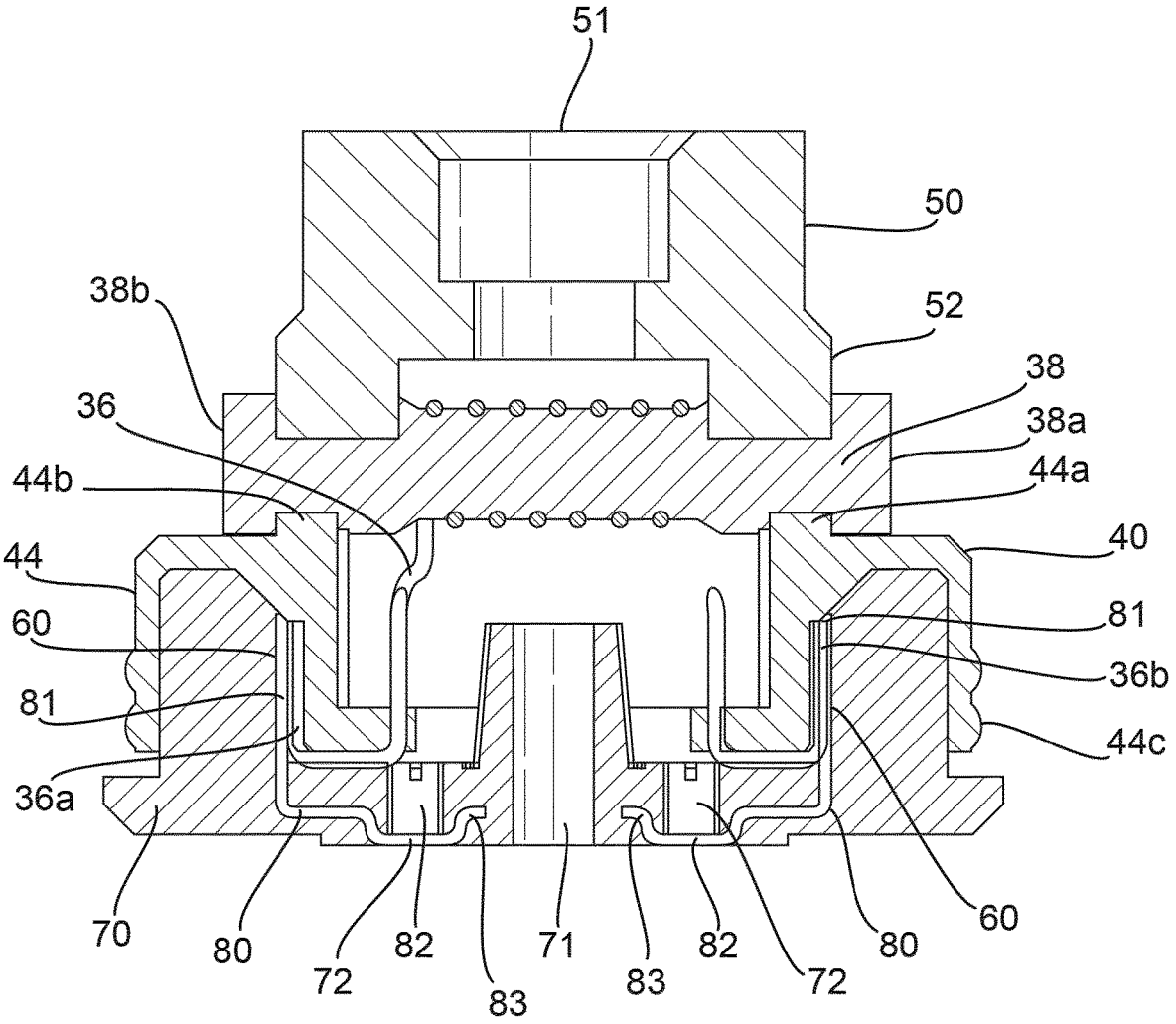
FIG. 6 is a schematic cross-sectional view of FIG. 5 in an assembled state.

As shown in FIGS. 6 and 7, the second seal 44 comprises a base portion 44*c* which acts to house components of the capsule such as the vaporizer housing 40. The base portion 44*c* can therefore be thought of as defining an internal cavity portion. The base portion 44*c* is configured to receive, and retain, a heating holder 70 such that the heating holder 70 is at least partially located within the base portion 44*c*. The base portion 44*c* of the second seal 44 is for receiving the vaporizer housing 40, acting as a support for the vaporizer housing 40, as shown in FIGS. 6 and 7. Specifically, the lower rim 42*b* of the vaporizer housing 40 is received by the second seal 44 so that the vaporizer housing 40 is held firmly and in its correct position within the capsule 16.

As can be seen in FIG. 6, the heating holder 70 is received and retained by the second seal 44 such that an interface 60 is formed between an internal surface of the base portion 44*c* of the second seal 44 and the heating holder 70. The heating element has first and second ends 36*a*, 36*b* which are held between the base portion 44*c* and the heating holder 70 at the interface 60 between the base portion 44*c* and the heating holder 70. The first and second ends 36*a*, 36*b* of the heating element are therefore clamped, or squeezed, between the base portion 44*c* and the heating holder 70. This ensures that the heating element 36 is held firmly in place within the capsule 16. Additionally, and advantageously, by clamping the first and second ends 36*a*, 36*b* of the heating element between the second seal 44 and the heating holder 70, the ends of the heating element 36 are prevented from coming in to contact with the electrical circuitry 8 in the main body 4. This configuration reduces the likelihood of any unwanted liquid which may be present in the heating element 36 to come into contact with the electrical components which can leads to short circuits.

The heating holder 70 is arranged to be connected to the base portion 44*c* of the second seal 44 for example by a push fit or snap fit connection. The heating holder 70 comprises a pair of through holes 72 or apertures 72 which are arranged to receive a pair of electrodes 80, as can be seen in FIG. 7. Each electrode 80 takes the form of a wire which has been substantially flattened such that each electrode 80 has a ribbon-like structure. In other words, each electrode 80 has a substantially rectangular cross section. By using a flattened structure for the electrodes 80 which substantially follow the internal structure of the capsule 16, space within the capsule 16 that may have been taken up by, for example, protruding electrodes 80 such as pins, is freed up. This configuration results in more space around the air hole 71 within the heating holder 70.

Each electrode 80 comprises a first end 81, a second end 83, and a middle portion 82 as shown in FIGS. 6 and 7. The first end 81 of each electrode 80 is located, or held, between the base portion 44*c* and the heating holder 70 at the interface 60 between the base portion 44*c* and the heating holder 70. Each of the first ends 81 of the electrodes 80 are therefore clamped, or squeezed, between the base portion 44*c* and the heating holder 70. This ensures that each electrode 80 is held firmly and securely in place within the capsule 16, without the need for any additional parts to secure the first end of the electrode 80. Using a clamping action between components of the capsule 16 also avoids the need for welding, or other similar attachment processes, which helps reduce the complexity of the capsule 16.

As mentioned previously, the first and second ends 36*a*, 36*b* of the heating element are also held, or clamped, between the base portion 44*c* and the heating holder 70. This means that both the first and second ends 36*a*, 36*b* of the heating element as well as the first end of each electrode 80 are located, or clamped, between the base portion 44*c* and the heating holder 70.

By clamping the first and second ends 36*a*, 36*b* of the heating element with the first end of each electrode 80 between the base portion 44*c* and the heating holder 70, a good electrical connection, or electrical contact point, is made between the heating element and the electrodes 80.

Figure 9A:
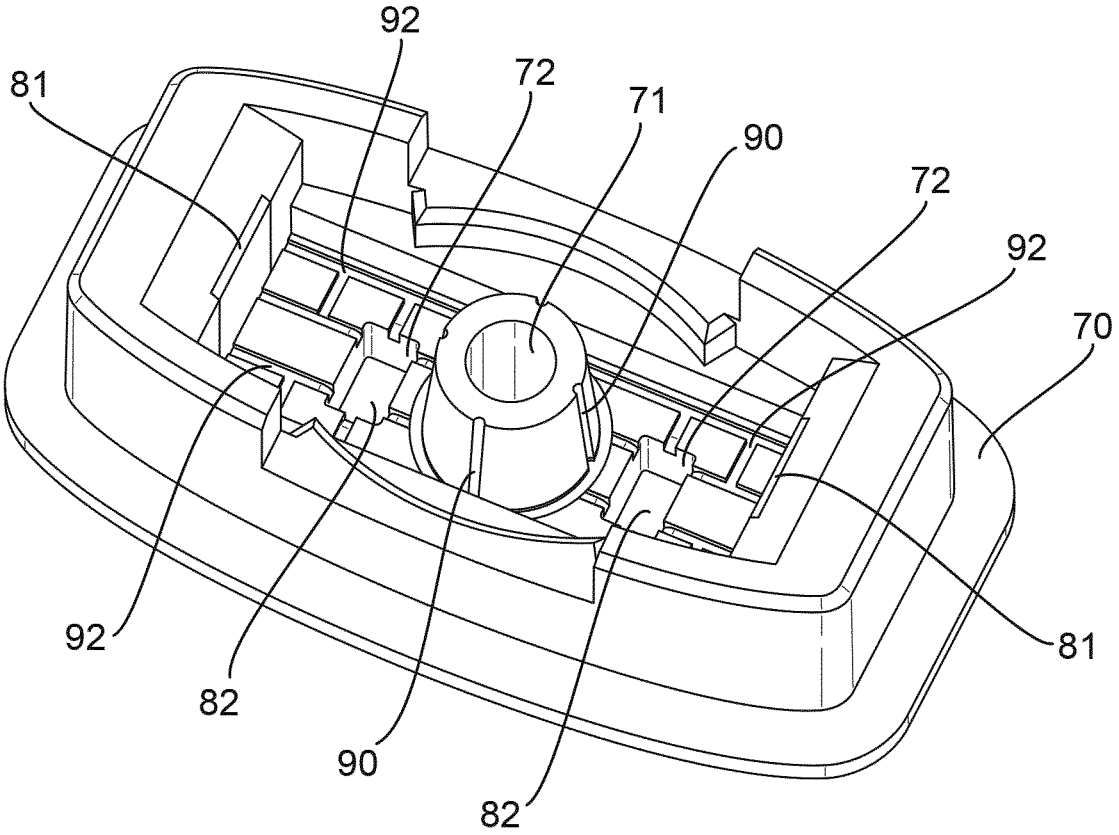
FIG. 9A is a perspective view of the internal structure of a capsule part.

As can be seen in FIGS. 7 and 9A, a part of the middle portion 82 of each electrode 80 extends across each aperture 72. In particular, a length of each middle portion 82 of each electrode 80 extends across the aperture 72 in a direction perpendicular to a longitudinal axis of the aperture 72. The portion of the electrode 80 that extends across the aperture 72 may be thought of as covering or blocking off the aperture 72. This has the effect that one side of the middle portion 82 of each electrode 80, specifically a lower side when the capsule 16 is held vertically, is exposed. By exposed, we mean that this portion is not within the heating holder 70. Instead, this exposed area is substantially flush to the external surface of the heating holder 70. This exposed surface provides an electrical connection point within the heating holder 70. The electrodes 80 therefore act as electrical connectors for the transfer of current between the capsule seating 12 and the capsule 16. As such, the electrodes 80 are made of any suitable material which is able to transfer current, for example a metal such as copper. The pair of apertures 72 in the heating holder 70 allows the transfer of current between the capsule seating 12 and the capsule 16.

The second end 83 of each electrode is secured within the heating holder 70, as shown in FIG. 7. The electrodes 80 may therefore be thought of as being embedded within the heating holder 70. A portion of the electrode between the first end 81 and the exposed portion 82 may also be secured within the heating holder 70. The electrode 80 may be partially embedded by molding the heating holder 70 partially over the electrode 80. The molding operation of the heating holder 70 may be plastic injection molding.

In addition to the pair of apertures 72 the heating holder 70 comprises a further air hole 71, in the form of a through bore passing through the main body of the heating holder 70, arranged to allow air to flow into the vaporizing chamber 30 via the air inlet 35 in the vaporizer unit 34. This air hole 71 therefore comprises part of the main vapor channel 24. The air hole 71 is located substantially centrally within the heating holder 70, as shown in FIG. 6, and the air hole 71 is arranged to have sufficient length such that it extends into the vaporizing chamber 30 of the vaporizer housing 40. The air hole 71 protrudes vertically upwards, i.e. in a direction parallel to a longitudinal axis of the capsule 16, from an internal base surface of the heating holder 70. The air hole 71 may therefore be thought of as having a chimney-like structure as so in some cases may be referred to as a chimney. In general, the chimney 71 will be integrally formed with the main body of the heating holder 70. Providing an air hole 71 which extends sufficiently far into the vaporizing chamber 30 ensures that intake air is delivered to the appropriate part of the capsule i.e. the vaporizing chamber 30.

The combination of a central protruding air hole 71 and embedded electrodes 80 means there is a lot of space between the fluid transfer element 38, the air hole 71, and the internal base surface of the heating holder 70. This helps ensure that there is sufficient air flow around the fluid transfer element such that the generated vapor can flow from the fluid transfer element 38 up the main vapor channel 24 to the mouthpiece 20.

FIG. 9 shows the internal structure of the heating holder 70 in more detail. As can be seen, the air hole 71, comprises a number of grooves 90 or recesses on the external surface of the chimney 71. The grooves 90 are evenly spaced apart from each other and extend longitudinally long the length of the chimney 71 from the base of the chimney 71 to the top of the chimney 71. These grooves 90 act to collect any fluid that might leak from the fluid transfer element 38 to the top of the chimney 71. This fluid will be drawn into the grooves 90 as a result of capillary action so that the fluid preferentially flows along the grooves 90 rather than along the surface of the chimney 71. The captured fluid can then be collected at the base of the chimney and drained from the heating holder 70.

Figure 9B:
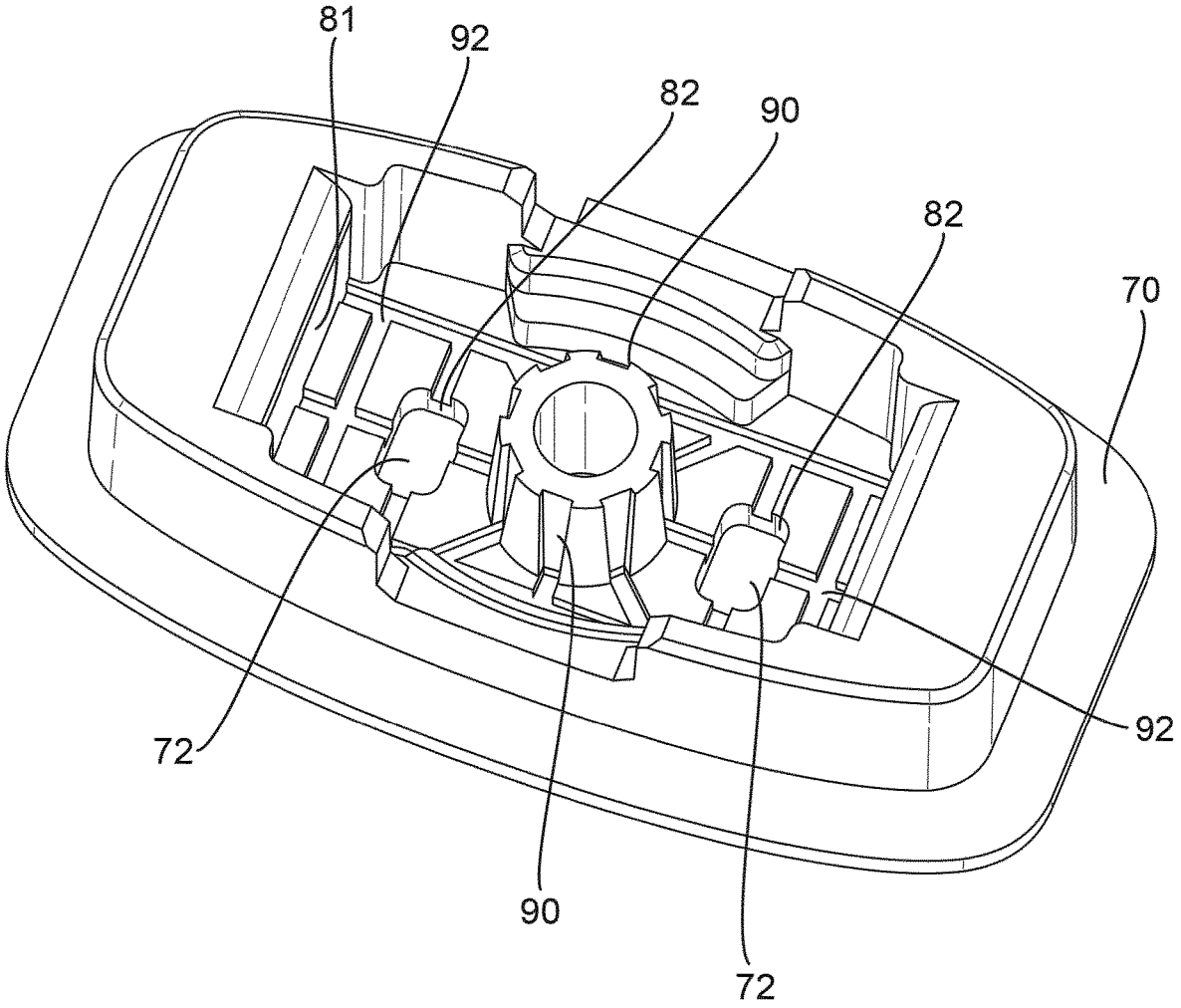
FIG. 9B is a perspective view of the internal structure of an alternative capsule part.

As well as the grooves 90 present on the surface of the chimney 71, the internal base surface of the heating holder 70 also comprises a number of grooves 92 forming a channel-like structure. The multiple channels 92 are fluidly connected to each other so that fluid present in one part of the channel-like structure can flow into another part. The grooves 90 on the surface of the chimney 71 are also fluidly connected to the channels 92 at the base of the chimney, as shown in FIG. 9B, so that fluid within the grooves 90 can flow into the channels 92. Similarly to the grooves 90, these channels are arranged to collect fluid that make leak from the fluid transfer element 38. Once the fluid has dropped from the fluid transfer element 38 onto the internal base surface of the heating holder 70, the channels 92 capture the fluid, via capillary action, and allow the fluid to be drained from the heating holder 70. The depth of these channels 92 can be maximized so that the channels act as a reservoir for the leaked fluid before the fluid is drained from the inside of the capsule.

Figure 10:
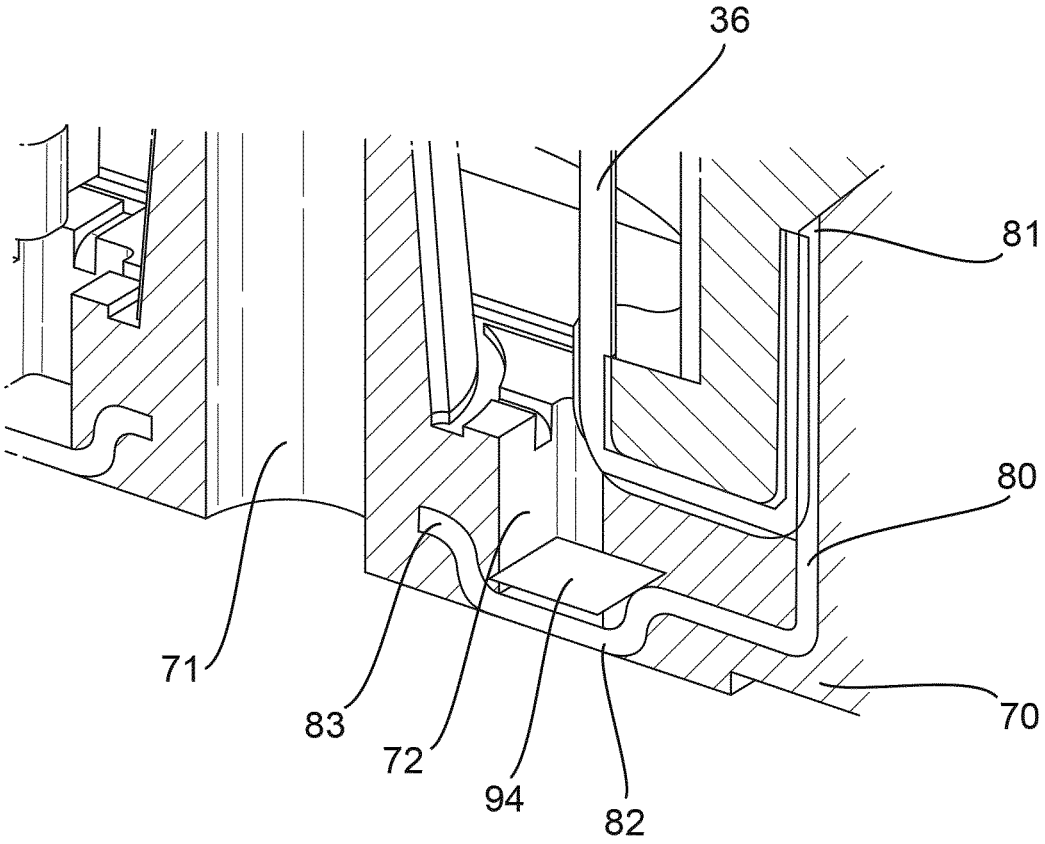
FIG. 10 is a cross-sectional view of the internal structure of a capsule.

As can be seen in FIG. 9B, the channels 92 are arranged to direct fluid towards the pair of apertures 72 in the base of the heating holder 70. In order to prevent the leaked, and subsequently captured, fluid from coming into contact with the middle portions 82 of the electrodes 80, each aperture 72 in the heating holder 70 comprises a cover 94 which has the form of a substantially planar surface shaped to correspond to the cross-section of the aperture 72 such that the cover 94 is able to seal the aperture 72 from any leaked fluid. Each cover 94 is therefore arranged to cover the exposed middle portion 82 of the respective electrode 80, as can be seen in FIG. 10, so that a barrier is formed between the electrode 80 and any fluid present within the heating holder 70. In general, the cover 94 is made from plastic material, but any other suitable material could be used that prevents the transfer of fluid through the aperture 72. Advantageously, the cover 94 acts to seal the electrode 80 from any fluid that may have leaked from the fluid transfer element 38 and collect within the heating holder 70. In this regard, the cover 94 may be thought of as a seal.

As shown, for example, in FIG. 5, the heating element 36, comprises a heating wire 36 which is wound around the fluid transfer element 38, and so takes the form of a heating coil. Typically, the heating element 36 is not directly connected to the electrodes 80 but is instead indirectly connected to the electrodes 80 via a plurality of lead wires, which act as an intermediate between the heating element 36 and the electrodes 80. The heating element 36 is connected to the lead wires generally near the fluid transfer element 38. The heating element 36 therefore comprises the heating wire 36 (also known as a heating coil) and lead wires, typically two lead wires. The heating wire 36 is generally connected to each lead wire by spot welding or clipper. In this description, the lead wires, specifically first and second lead wires, of the heating element may also be referred to as first and second ends of the heating element. The heating wire 36 is configured to heat the fluid transfer element 38 by resistive heating. In an advantageous embodiment, the material of the heating wire 36 can be titanium. Titanium has a steep resistance to temperature curve in comparison with e.g. stainless steel or nickel. Hence, the resistance of the heating wire 36 increases relatively rapidly with an increasing coil temperature. However, other materials such as Stainless steel, Nickel, Chrome or Aluminium or alloys thereof are also possible.

The main body 4 is configured to supply power to the heating element 36 of the capsule and to control the overall operation of the vaporization. The main body 4 can be configured as a compact device in comparison to most prior art electronic cigarettes. Preferably, the device is provided with a dimension that it will fit into the palm of a hand.

The electrical circuitry 8 of the main body 4 is configured to operate the electronic cigarette 2 and may comprise a flow sensor 10 or a manual activation switch, a memory 11 and a controller 13. The electrical circuitry 8 may advantageously be grouped onto a main printed circuit board.

The skilled person will realize that the present invention by no means is limited to the described exemplary embodiments. The mere fact that certain measures are recited in mutually different dependent claims does not indicate that a combination of these measures cannot be used to advantage. Moreover, the expression "comprising" does not exclude other elements or steps. Other non-limiting expressions include that "a" or "an" do not exclude a plurality and that a single unit may fulfill the functions of several means. Any reference signs in the claims should not be construed as limiting the scope. Finally, while the invention has been illustrated in detail in the drawings and in the foregoing description, such illustration and description is considered illustrative or exemplary and not restrictive; the invention is not limited to the disclosed embodiments.

The invention claimed is:

1. A capsule for an electronic cigarette, the capsule having a first end configured to engage with an electronic cigarette device and a second end having a vapor outlet, the capsule further comprising:

a liquid store configured to contain a liquid to be vaporized;

a vaporizer housing arranged to house at least a part of a heating element and a part of a fluid transfer element, wherein the fluid transfer element is arranged to deliver liquid from the liquid store to the heating element, the heating element being configured to vaporize the received liquid and generate a vapor;

a seal arranged to hold the vaporizer housing;

a holder arranged to attach to the seal;

a main gas flow channel extending between the vaporizer housing and the vapor outlet to allow the generated vapor to flow from the vaporizer housing to the vapor outlet;

a pair of electrodes, wherein the pair of electrodes are arranged to provide an electrical connection between the first end of the capsule and an electronic cigarette device;

wherein the holder comprises an airflow passageway, and wherein the airflow passageway comprises a plurality of grooves on an external surface of the airflow passageway.

2. The capsule according to claim 1, wherein the main gas flow channel extends from the holder, through the seal, to the vaporizer housing.

3. The capsule according to claim 1, wherein the vaporizer housing comprises a vaporizing chamber surrounding the airflow passageway.

4. The capsule according to claim 1, wherein the airflow passageway is located substantially centrally within a surface of the holder.

5. The capsule according to claim 1, wherein the plurality of grooves are substantially straight.

6. The capsule according to claim 1, wherein the plurality of grooves extend longitudinally along the external surface of the airflow passageway.

7. The capsule according to claim 1, wherein the holder comprises a plurality of channels located within an internal surface of the holder.

8. The capsule according to claim 7, wherein at least one of the plurality of grooves is in fluid communication with at least one of the plurality of channels.

9. The capsule according to claim 1, wherein an interface is formed between an internal surface of the seal and an internal surface of the holder.

10. The capsule according to claim 9, wherein the heating element comprises first and second lead wires, and wherein the first and second lead wires are located at the interface between the seal and the holder.

11. The capsule according to claim 10, wherein the first and second lead wires of the heating element are compressed between the seal and the holder at the interface.

12. An electronic cigarette comprising a main body and the capsule according to claim 1, wherein the main body comprises a power supply unit, electrical circuitry, and a capsule seating configured to connect with the capsule.

13. A capsule for an electronic cigarette, the capsule having a first end configured to engage with an electronic cigarette device and a second end having a vapor outlet, the capsule further comprising:

a liquid store configured to contain a liquid to be vaporized;

a vaporizer housing arranged to house at least a part of a heating element and a part of a fluid transfer element, wherein the fluid transfer element is arranged to deliver liquid from the liquid store to the heating element, the heating element being configured to vaporize the received liquid and generate a vapor;

a seal arranged to hold the vaporizer housing;

a holder arranged to attach to the seal;

a main gas flow channel extending between the vaporizer housing and the vapor outlet to allow the generated vapor to flow from the vaporizer housing to the vapor outlet;

a pair of electrodes, wherein the pair of electrodes are arranged to provide an electrical connection between the first end of the capsule and an electronic cigarette device;

wherein the holder comprises an airflow passageway, and wherein the holder comprises a plurality of channels located within an internal surface of the holder.

14. The capsule according to claim 13, wherein the main gas flow channel extends from the holder, through the seal, to the vaporizer housing.

15. The capsule according to claim 13, wherein the vaporizer housing comprises a vaporizing chamber surrounding the airflow passageway.

16. The capsule according to claim 13, wherein the airflow passageway is located substantially centrally within a surface of the holder.

17. The capsule according to claim 13, wherein an interface is formed between an internal surface of the seal and the internal surface of the holder.

18. The capsule according to claim 17, wherein the heating element comprises first and second lead wires, and wherein the first and second lead wires are located at the interface between the seal and the holder.

19. The capsule according to claim 18, wherein the first and second lead wires of the heating element are compressed between the seal and the holder at the interface.

20. An electronic cigarette comprising a main body and the capsule according to claim 13, wherein the main body comprises a power supply unit, electrical circuitry, and a capsule seating configured to connect with the capsule.

* * * * *